US006929340B2

(12) United States Patent
Ishizaki

(10) Patent No.: US 6,929,340 B2
(45) Date of Patent: Aug. 16, 2005

(54) DRIVE CIRCUIT OF INK JET HEAD AND DRIVING METHOD OF INK JET HEAD

(75) Inventor: Sunao Ishizaki, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/050,539

(22) Filed: Jan. 18, 2002

(65) Prior Publication Data

US 2002/0097285 A1 Jul. 25, 2002

(30) Foreign Application Priority Data

Jan. 22, 2001 (JP) ..... 2001-012921

(51) Int. Cl.[7] ..... B41J 29/38

(52) U.S. Cl. ..... 347/5; 347/9; 347/68; 347/10

(58) Field of Search ..... 347/9, 10, 11, 347/19, 68, 12, 14, 15, 211, 5; 323/280

(56) References Cited

U.S. PATENT DOCUMENTS 5,384,583 A * 1/1995 Katerberg et al. ..... 347/19
6,068,360 A * 5/2000 Hiwada ..... 347/14
6,273,538 B1 * 8/2001 Mitsuhashi et al. ..... 347/11
6,334,668 B1 * 1/2002 Isamoto ..... 347/57

FOREIGN PATENT DOCUMENTS

EP 0995599 A2 * 4/2000
JP 9-174883 7/1997
JP 10-315451 12/1998

* cited by examiner

*Primary Examiner*—Hai Pham
*Assistant Examiner*—Lam Nguyen
(74) *Attorney, Agent, or Firm*—Dickstein, Shapiro, Morin & Oshinsky, LLP.

(57) ABSTRACT

In order to improve dullness of waveform of a drive signal having high slew rate necessary to jet ink droplets, which is caused by an influence of a low-pass filter formed by a resistance of a cable for connecting a power amplifier of an ink jet printer to piezo-electric heads of the printer, which are remote physically from the power amplifier, and a capacitance of the piezo-electric actuators, the ink jet printer includes intermediate circuit board 22 mounted on a carriage, control circuit board 11 having power amplifier 111 and cable 13, wherein a negative feedback loop is provided from inputs of transfer gates mounted on intermediate circuit board 12 through wiring 114 to power amplifier 111 mounted on control circuit board 11.

3 Claims, 7 Drawing Sheets

DRIVE CIRCUIT OF INK JET HEAD AND DRIVING METHOD OF INK JET HEAD

BACKGROUND OF THE INVENTION

1. Field of the Invention

The present invention relates to a driving circuit of an ink jet head using a piezo-electric actuator and a driving method of an ink jet head and, in particular, the present invention relates to a driving circuit of an ink jet head performing a high quality color image recording by jetting ink droplets and a driving method of the ink jet head.

2. Description of Related Art

In general, a conventional image processing technology for performing highly precise image recording has been of the gray level recording system using the area gray level correction of the dither system. Recently, however, it is requested to print an image having photographic quality at high speed. In order to satisfy such request, it is preferable to improve the image quality by providing a number of nozzles in an image forming device to realize a high speed printing and by controlling the image forming device such that minute ink droplets are jetted from the nozzles. Further, the size of ink droplet must be variable. This control system is called as droplet diameter modulation system. Normally, the size of ink droplet jetted from the nozzle can be regulated by controlling a voltage applied to the piezo-electric actuator.

An example of the conventional image forming device using the droplet diameter modulation system is disclosed in JP H10-315451A. In the disclosed image forming device, it is proposed that a driving waveform generated by a waveform generator and amplified by a power amplifier is supplied to all of piezo-electric actuators and the ink jetting is ON/OFF controlled by an image data.

Describing the proposed conventional system in detail with reference to FIG. 3, a drive waveform generated by waveform generator 312 is amplified by power amplifier 311 having a low output impedance to obtain a power capable of driving piezo-electric actuators 321 and ink droplets are jetted by opening/closing transfer gates 322 by the image data.

Another example of the proposed conventional system using the droplet diameter modulation system is disclosed in JP H9-174883 A. As shown in FIG. 5, which shows the another example, power amplifier 522 is provided for each of piezo-electric actuators 523 and the ink jetting is ON/OFF controlled by interface circuits 521 each for determining supply of drive waveform generated by waveform generator 511 to individual power amplifiers 522.

Incidentally, in order to jet minute droplet from an ink jet head using the piezo-electric actuator, drive waveform therefor has to have a large potential difference within a short time, that is, a large slew rate, and the slew rate of at least 10 (V/$\mu$s) is required recently. The piezo-electric actuator is a capacitive load and, when it is constructed with a laminated ceramics, electrostatic capacitance of each piezo-electric actuator is in the order of 3000 (pF). Further, since, in order to perform a high speed printing, the ink jet head has to have about 300 nozzles, a total electrostatic capacitance becomes up to 0.9 ($\mu$F). Therefore, the low output impedance power amplifier is used.

In a case of a serial printer, an ink jet head is mounted on a carriage and reciprocated perpendicularly to a moving direction of a printing sheet. A substrate on which power amplifiers are mounted is connected to piezo-electric actuators, which are loads of the power amplifiers, by a flexible cable. In such case, length of the flexible cable becomes 50 (cm) or more. Since electric resistance of the cable and electrostatic capacitance of the piezo-electric actuators form a low-pass filter, waveform of a voltage applied to a terminal of a piezo-electric actuator (referred to as "terminal voltage", hereinafter) becomes dull, even if drive waveform having high slew rate can be obtained by using a power amplifier having low output impedance as in the technique disclosed in JP H10-315451 A.

FIG. 4 shows an influence of the low-pass filter on the terminal voltage of the piezo-electric actuator. In FIG. 4, it is assumed that electrostatic capacitance of each piezo-electric actuator is 3000 (pF), the number of nozzles formed in the ink jet head is 300, that is, a total electrostatic capacitance as a load of the voltage amplifiers is 0.9 ($\mu$F), and electric resistance of the cable is 0.5 ($\Omega$). As shown, actual terminal voltage 42 of the piezo-electric actuator becomes dull compared with ideal waveform 41 due to the influence of the low-pass filter. The influence of the low-pass filter on the terminal voltage may cause the jetting of ink droplets to be unstable.

On the other hand, in order to realize the high speed printing, a number of nozzles must be provided. However, the larger number of the nozzles are provided the larger total electrostatic capacitance results, so that the cut-off frequency of the low-pass filter is lowered and dullness of the waveform of the terminal voltage becomes more remarkable.

The cut-off frequency depends upon a product of electric resistance and electrostatic capacitance of the cable. However, since the number of nozzles to be driven simultaneously is changed time to time, there is a problem that the dullness of the waveform varies correspondingly.

Since, in the technique disclosed in JP H9-174883 A, a plurality of power amplifiers 522 are mounted on the carriage with one piezo-electric actuator 523 being provided for each of power amplifiers 522, they are under influence of the low-pass filter. However, if the number of nozzles is increased in order to realize a high speed printing, the number of the power amplifiers must be increased, resulting in not only the size of the construction of the printer but also the amount of heat generation are increased much.

In order to solve this increased heat generation problem, the technique disclosed in JP H9-174883 A requires a heat radiation fan on the carriage. Therefore, weight of the carriage becomes large. On the other hand, in the ink jet printer of the serial type, the carriage must be driven reciprocally, an increase of weight of the carriage may cause vibration during acceleration and deceleration of the reciprocating carriage, resulting in that the image quality is degraded.

In order to avoid the vibration problem, sudden acceleration and sudden deceleration of the carriage must be avoided. However, in order to make the acceleration and deceleration of the carriage slow, a moving distance of the reciprocating carriage becomes long, causing the size of the printer to be increased.

SUMMARY OF THE INVENTION

The present invention was made in view of the above mentioned problems of the conventional ink jet printer and has an object to provide an ink jet drive circuit capable of stably jetting ink droplets, by improving dullness of terminal voltage waveforms of piezo-electric actuators due to influence of the low-pass filter by forming a low-pass filter with using electric resistance of a cable existing between power amplifiers and an ink jet head and electrostatic capacitance of the piezo-electric actuators. Another object of the present invention is to provide a drive method of the ink jet head.

According to a first aspect of the present invention, a drive circuit of an ink jet head, which includes piezo-electric actuators provided correspondingly to respective pressure generating chambers filled with ink to be jetted from nozzles, for jetting ink droplets from the nozzles by changing volumes of the pressure generating chambers by applying drive waveform signals to the piezo-electric actuators, is featured by comprising a waveform generator for generating the drive waveform signal and a power amplifier for amplifying the drive waveform signal and outputting the amplified drive waveform signal to the piezo-electric actuators, the power amplifier having one input supplied with the drive waveform signal and the other input to which a terminal voltage of the piezo-electric actuator is fedback.

According to a second aspect of the present invention, a drive circuit of an ink jet head, which includes piezo-electric actuators provided correspondingly to respective pressure generating chambers filled with ink to be jetted from nozzles, for jetting ink droplets from the nozzles by changing volumes of the pressure generating chambers by applying drive waveform signals to the piezo-electric actuators, is featured by comprising a waveform generator for generating the drive waveform signal and a power amplifier having one input supplied with the drive waveform signal and the other input supplied with a sum of a feedback signal, which is a terminal voltage of the piezo-electric actuator, and an output signal of the power amplifier.

In the drive circuit according to either the first or second aspect of the present invention, it is preferable that a feedback loop for feeding back the terminal voltage of the piezo-electric actuator includes a capacitor for leading to phase of the terminal voltage in high frequency range.

According to a third aspect of the present invention, a drive method of an ink jet head which includes piezo-electric actuators provided correspondingly to respective pressure generating chambers filled with ink to be jetted from nozzles, for jetting ink droplets from the nozzles by changing volumes of the pressure generating chambers by applying drive waveform signals to the piezoelectric actuators, is featured by comprising the steps of generating a drive waveform signal, inputting the drive waveform signal to one input terminal of a power amplifier, applying a signal obtained by amplifying the drive waveform signal to piezo-electric actuators, dividing the amplified drive waveform signal and feeding back the divided amplified drive waveform signal to the other input of the power amplifier.

According to a fourth aspect of the present invention, a drive method of an ink jet head, which includes piezo-electric actuators provided correspondingly to respective pressure generating chambers filled with ink to be jetted from nozzles, for jetting ink droplets from the nozzles by applying drive waveform signals to the piezo-electric actuators to change volumes of the pressure generating chambers, is featured by comprising the steps of generating a drive waveform signal, inputting the drive waveform signal to one input terminal of a power amplifier, applying a signal obtained by amplifying the drive waveform signal to a piezo-electric actuator, dividing the amplified drive waveform signal and feeding back a sum of the divided amplified drive waveform signal and an output signal of the power amplifier to the other input of the power amplifier.

According to a fifth aspect of the present invention, a drive circuit of an ink jet head of a serial type ink jet printer, which includes a carriage mounting nozzles and pressure generating chambers thereon and in which ink droplets are jetted from the nozzles by sharply changing volumes of the pressure generating chambers filled with ink by applying drive waveform signal to piezo-electric actuators provided corresponding to the respective pressure generator chambers while moving the carriage reciprocally in a direction perpendicular to a feeding direction of a printing sheet, comprises a control circuit board mounting a waveform generator for generating a signal for driving the ink jet head, a power amplifier for amplifying the output signal of the waveform generator to an electric power capable of driving the ink jet head, an image memory for storing printing data and a data transmitter for transmitting the image data stored in the image memory as a serial data thereon, an intermediate circuit board mounted on the carriage and mounting a data receiver for receiving the serial data from the data transmitter, transfer gates for selecting piezo-electric actuators on the basis of the received printing data and a level shifter for matching voltage levels of the data receiver and the transfer gates thereon, a cable for connecting the control circuit board and the intermediate circuit board each other and a negative feedback loop including a resistor and a capacitor and provided from inputs of the transfer gates connected to the intermediate circuit board to the power amplifier mounted on the control circuit board.

Preferably, the ink jet head drive circuit of the serial type ink jet printer further comprises a negative feedback loop including a resistor and provided between an output and an input of the power amplifier mounted on the control circuit board.

BRIEF DESCRIPTION OF THE DRAWINGS

Specific embodiments of the present invention will now be described, by way of example only, with reference to the accompanying of drawings in which.

DETAILED DESCRIPTION OF THE PREFERRED EMBODIMENTS

Figure 1:
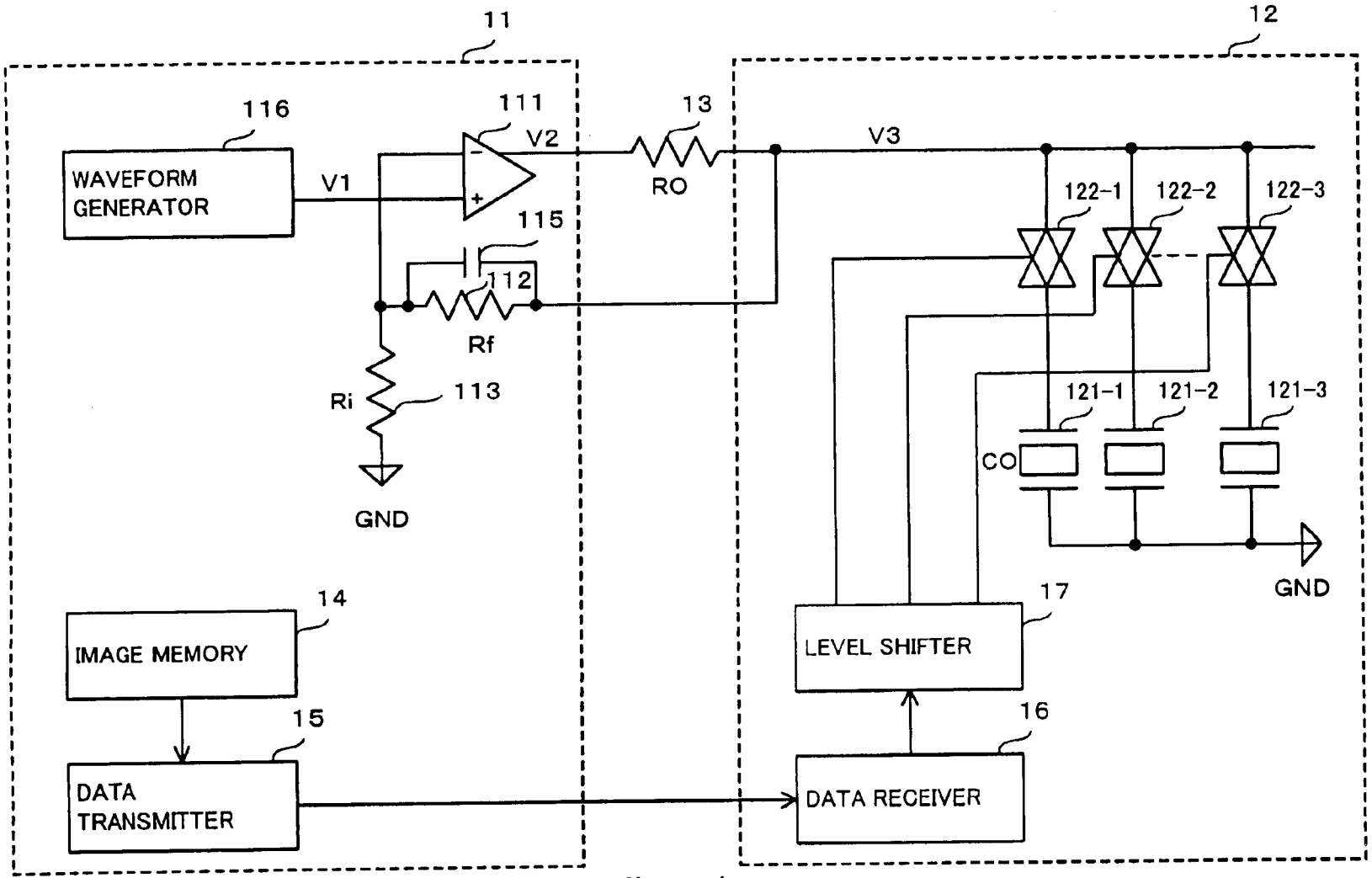
FIG. 1 is a circuit diagram of an ink jet head drive circuit according to a first embodiment of the present invention.

FIG. 1 is a circuit diagram of an ink jet head drive circuit according to an embodiment of the present invention. In FIG. 1, image memory 14 provided in control circuit board 11 stores a color image data for one printing line to be printed by a serial printer. The color image data stored in image memory 14 and outputted in parallel is converted into a serial data by data transmitter 15 provided in control circuit board 11. The serial data is sent to data receiver 16 mounted on intermediate circuit board 12 arranged on a carriage and reconverted into the parallel data. The latter parallel data is converted into a voltage with which transfer gates 122 can be operated, by level shifter 17, which is provided in intermediate circuit board 12.

Control circuit board 11 is physically separated from intermediate circuit board 12 and, therefore, a cable for connecting control circuit board 11 to intermediate circuit board 12 is necessary. The use of the serial data in a data transmission between control circuit board 11 and intermediate circuit board 12 is to reduce the number of signals to be transmitted through the cable.

Figure 4:
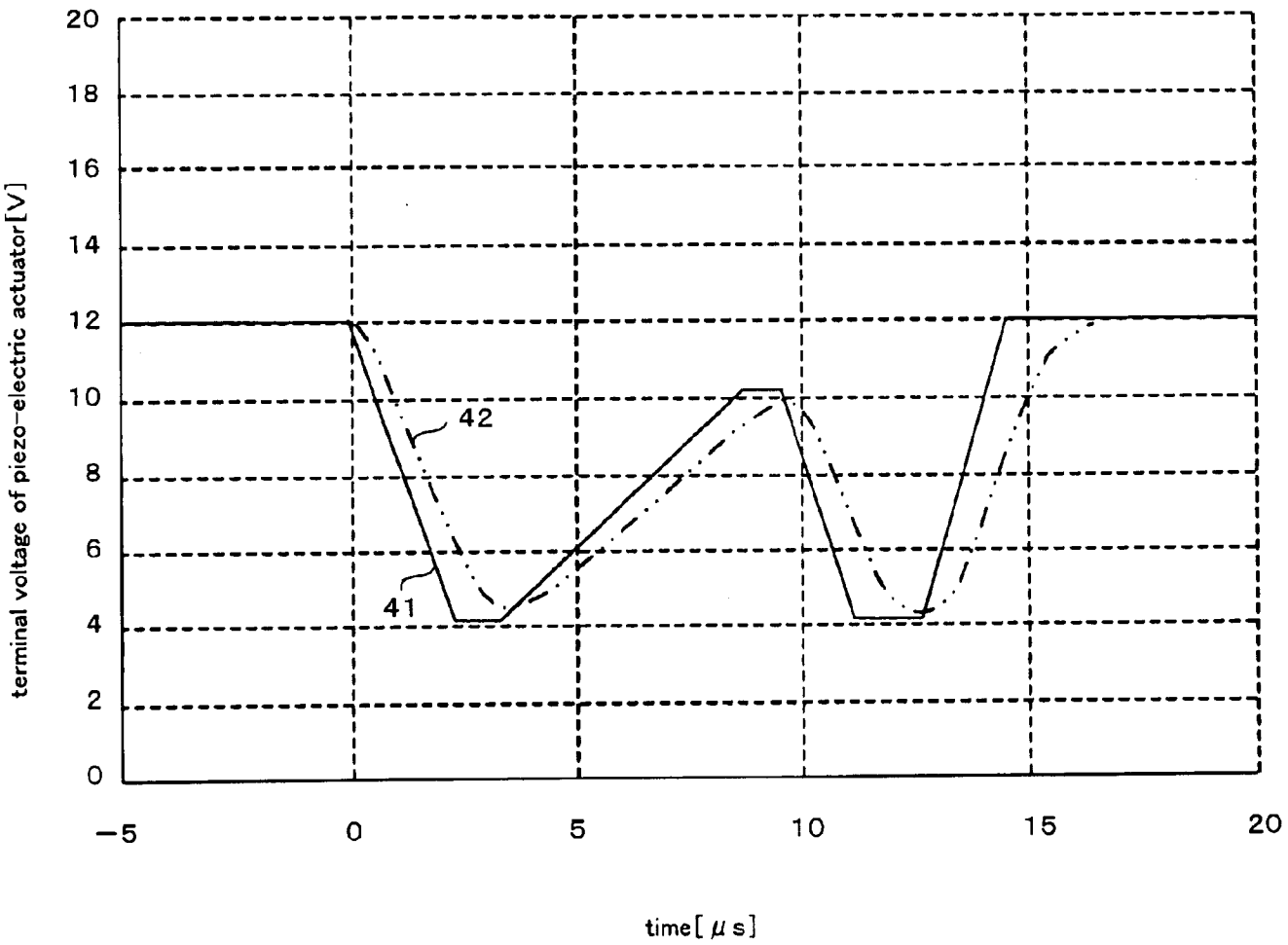
FIG. 4 illustrates waveform dullness caused by a conventional ink jet head drive circuit.
Figure 5:
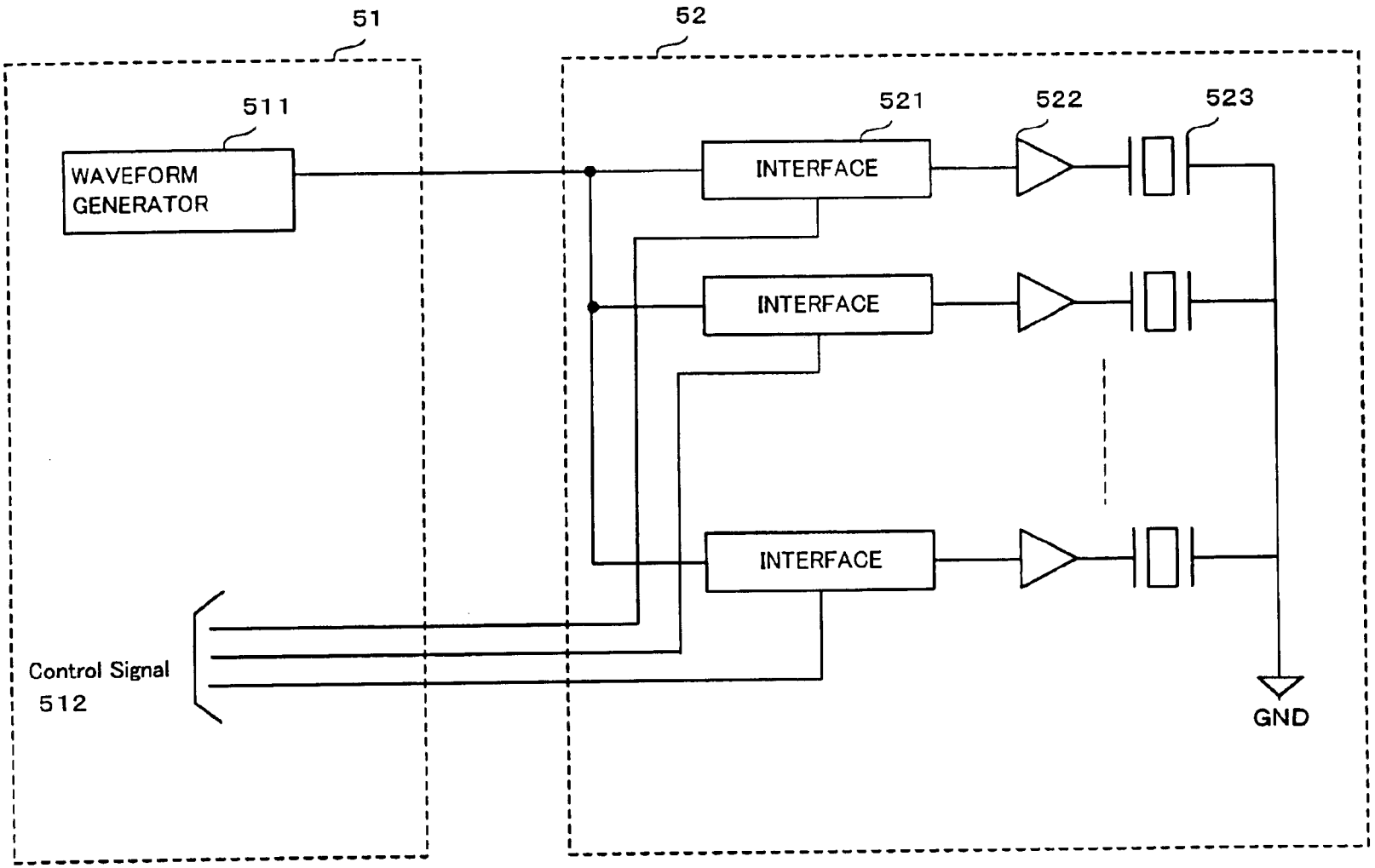
FIG. 5 is a circuit diagram of a second example of a conventional ink jet head drive circuit.

Waveform generator 116 included in control circuit board 11 generates ideal waveform 41 shown in FIG. 4. An output voltage $V_1$ of waveform generator 116 is inputted to a non-inverted input terminal of power amplifier 111 included in control circuit board 11. An electric resistance of cable 13 is $R_0$, which is usually 0.5 to 1 (Ω). Wiring 114 is a negative feedback line from inputs of transfer gates 122 mounted on intermediate circuit board 12 to control circuit board 11. Resistors 112 and 113 determine an amplification factor of an output voltage $V_2$ of power amplifier 111 to the input voltage $V_1$ thereof and the amplification factor G is given by the following equation (1):

$$G=1+R_f/R_i \quad (1)$$

Since there is the negative feedback line between control circuit board 11 and intermediate circuit board 12 in order to negatively feedback from inputs of transfer gates 122 to control circuit board 11, an output impedance of power amplifier 111 is sufficiently smaller than a load impedance of piezo-electric actuator 121. Further, since a resistance of transfer gate 122 when the latter is in ON state is sufficiently small, a terminal voltage of piezo-electric actuator 121 can be considered as being equal to an input voltage $V_3$ of transfer gate 122.

Figure 3:
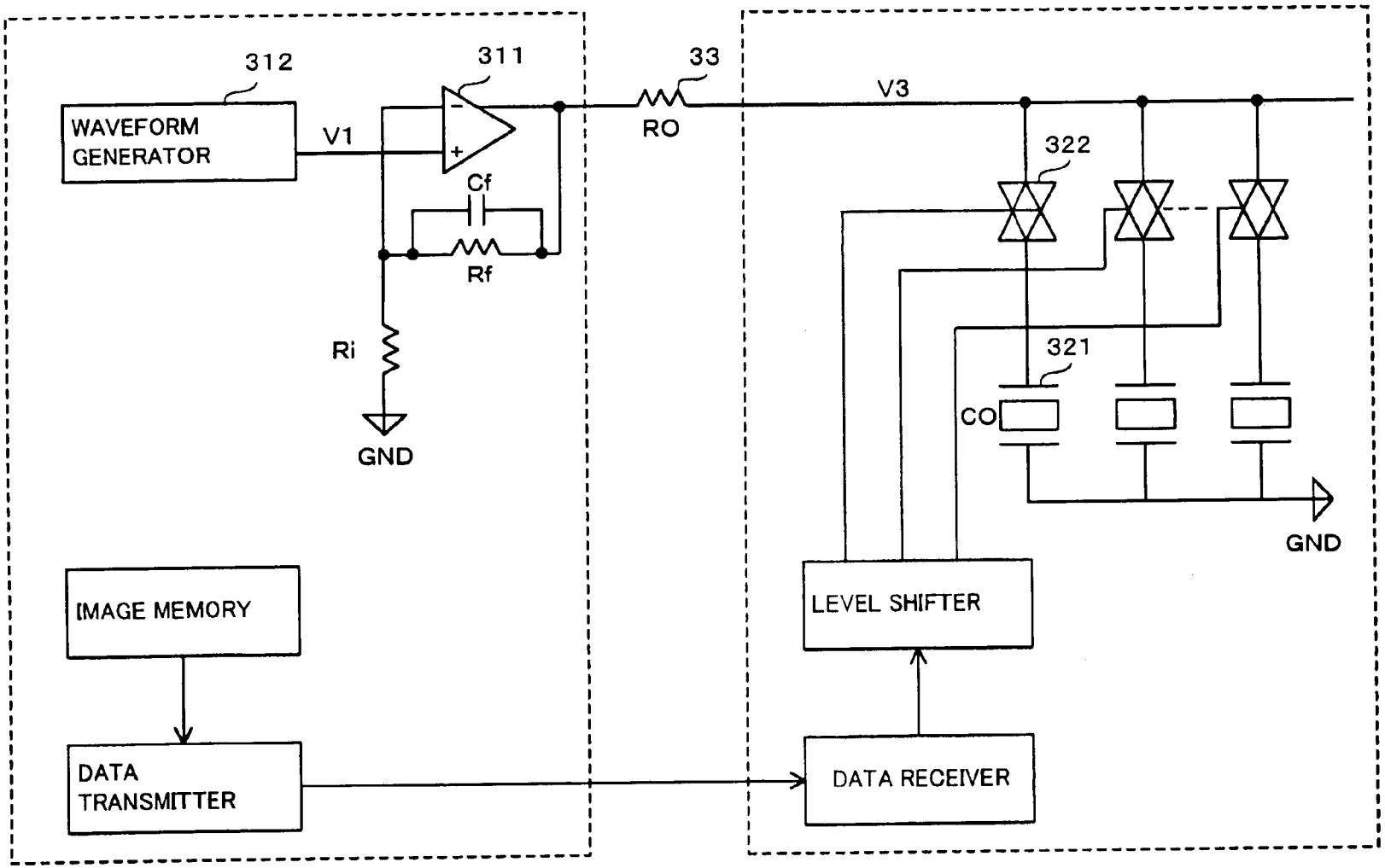
FIG. 3 is a circuit diagram of a first example of a conventional ink jet head drive circuit.

When there is no negative feedback line provided between intermediate circuit board 12 to an input of transfer gate 322 as shown in FIG. 3, amplification factor of the terminal voltage $V_3$ of piezo-electric actuator 321 to an output voltage $V_1$ of waveform generator 312 is given by the following equation (2):

$$V_3/V_1=\{A/(1+A/G)\}H(j\omega)=\{1/(1/A+1/G)\}H(j\omega)=H(j\omega)(A->\infty) \quad (2)$$

where G is the amplification factor in low frequency range, which is given by the equation (1), A is a bare amplification factor of power amplifier 311, H(jω) is transfer function of a low-pass filter formed by a distributed resistance $R_0$ of cable 33 and a total electrostatic capacitance of piezo-electric actuators 321-1, 321-2, . . . and given by the following equation (3):

$$H(j\omega)=(1/CR_0)/(j\omega+1/CR_0) \quad (3)$$

where ω is given for a frequency component f of ideal waveform 41 by the following equation (4):

$$\omega=2\pi f \quad (4)$$

where j is imaginary number unit and given by the following equation (5):

$$j=(-1)^{1/2} \quad (5)$$

As shown by the equation (2), when the bare amplification factor A of power amplifier 311 is large enough, $V_3/V_1$ becomes equal to H(jω). That is, since the terminal voltage of piezo-electric actuators 321-1, 321-2, . . . depends practically upon the frequency component of ideal waveform 41 shown in FIG. 4, amplification factor $V_3/V_1$ of the terminal voltage $V_3$ of piezo-electric actuator 321 to the output voltage $V_1$ of waveform generator 312 in high frequency range becomes small. Therefore, an actual waveform of the terminal voltage $V_3$ of piezo-electric actuator 321 becomes dull as shown by reference numeral 42 in FIG. 4.

On the other hand, the amplification factor $V_3/V_1$ of the drive circuit shown in FIG. 1 is given by the following equation (6):

$$V_3V_1=AH(j\omega)/(1+AH(j\omega)/G)=1/\{1/AH(j\omega)+1/G)\}=G(A->\infty) \quad (6)$$

As will be clear from the equation (6), when the bare amplification factor A of power amplifier 111 is made large similarly to the case shown in FIG. 3, the amplification factor $V_3/V_1$ of the terminal voltage $V_3$ of piezo-electric actuator 321 to the output voltage $V_1$ of waveform generator 312 in the construction shown in FIG. 1 becomes equal to G given by the equation (1), so that it is independent from the frequency component f of ideal waveform 41. Therefore, the amplification factor $V_3/V_1$ in high frequency range becomes small and the actual waveform of the terminal voltage $V_3$ of piezo-electric actuator 121 does not become dull.

Further, as described previously, the drive circuit according to this embodiment includes the low-pass filter formed by resistor 13 and the total electrostatic capacitance C of piezo-electric actuators 121. Therefore, when the frequency of the output voltage $V_1$ of waveform generator 116 becomes high, the phase delay of the voltage $V_3$ is increased correspondingly, so that risk of oscillation becomes high. In this embodiment, however, there is capacitor 115 in the feedback line for the voltage $V_3$. Since capacitor 115 functions to lead to phase in high frequency range, the phase delay of the low-pass filter is compensated for and the oscillation problem can be avoided by using the phase delay compensated voltage as the input to the inverted input terminal of power amplifier 111.

Figure 6:
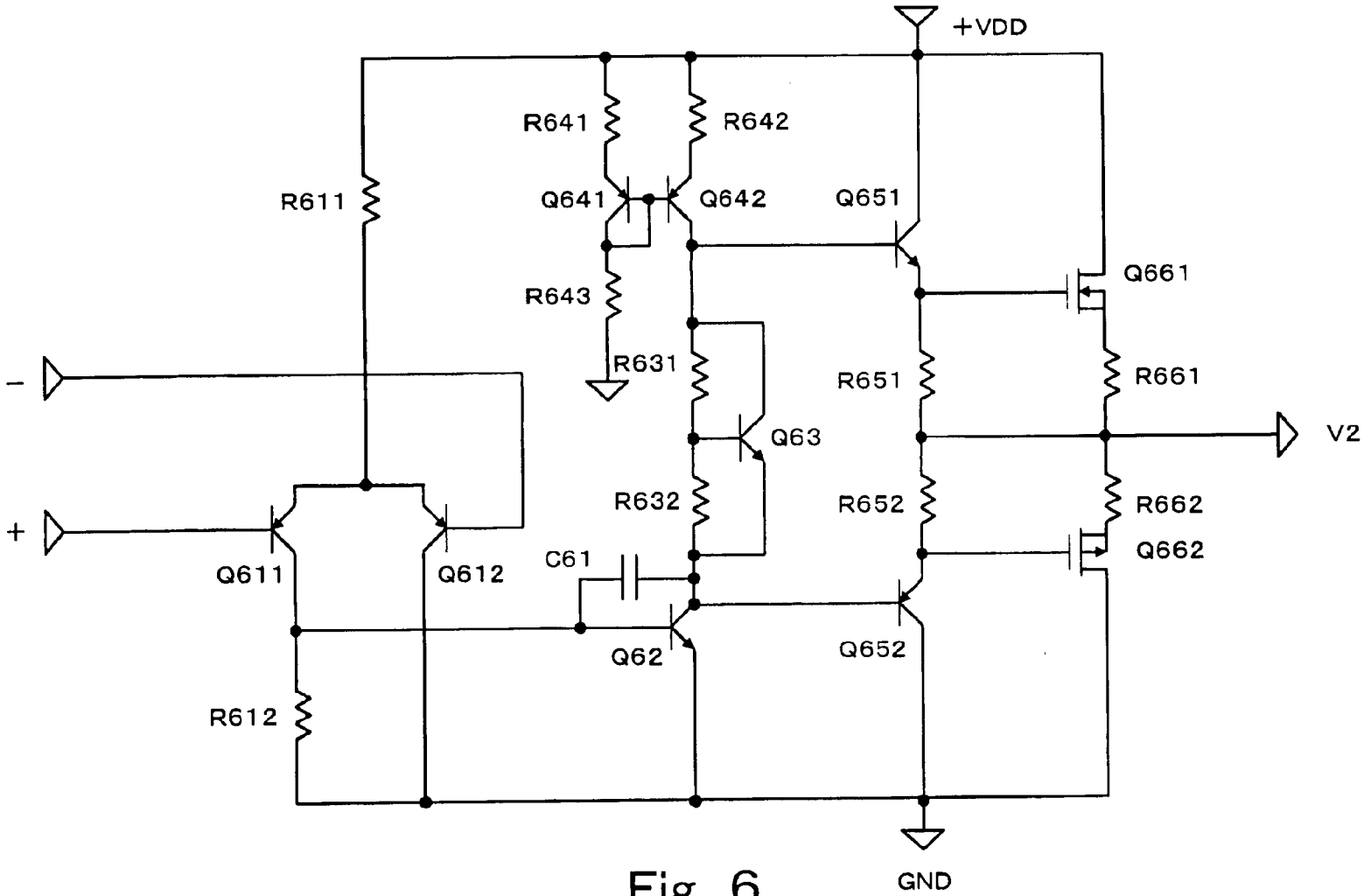
FIG. 6 is a circuit diagram of a power amplifier to be used in the ink jet head drive circuit of the present invention.

FIG. 6 is a circuit diagram of a concrete example of power amplifier 111. In FIG. 6, transistors Q611 and Q612 and resistors R611 and R612 constitute a differential amplifier at a collector terminal of transistor Q611 of which becomes a voltage proportional to a difference in base input voltage between transistors Q611 and Q612. Transistor Q62 constitutes the voltage amplifier and a load impedance is constituted with a constant current circuit composed of transistors Q641, Q642 and Q643. Therefore, the load impedance is very high and the bare amplification factor of power amplifier 111 can be deemed as infinite practically.

MOS FET's Q661 and Q662 constitute a source follower and perform a current amplification. Transistors Q651 and Q652 constitute a buffer between the voltage amplifier and the current amplifier. The MOS FET's are used in order to obtain high amplification factor up to high frequency range.

However, since the MOS FET has an input capacitance between a gate and a source thereof, impedance thereof is lowered in high frequency range when a load of the voltage amplifier is connected thereto. Therefore, the bare amplification factor of power amplifier 111 in high frequency range is lowered. The buffer is inserted in order to prevent the bare amplification factor of power amplifier 111 from being lowered in high frequency range.

Transistor R63 and resistors R631 and R632 constitute a bias circuit for compensating for base/emitter voltages and gate/source voltages of transistors Q651, Q661, Q652 and Q662 so that waveform of current flowing through the piezo-electric actuators is not distorted in transition of the current from charging to discharging as well as from discharging to charging. Capacitor 61 is provided for phase compensation to prevent oscillation when power amplifier 111 constitutes a feedback circuit.

Figure 7:
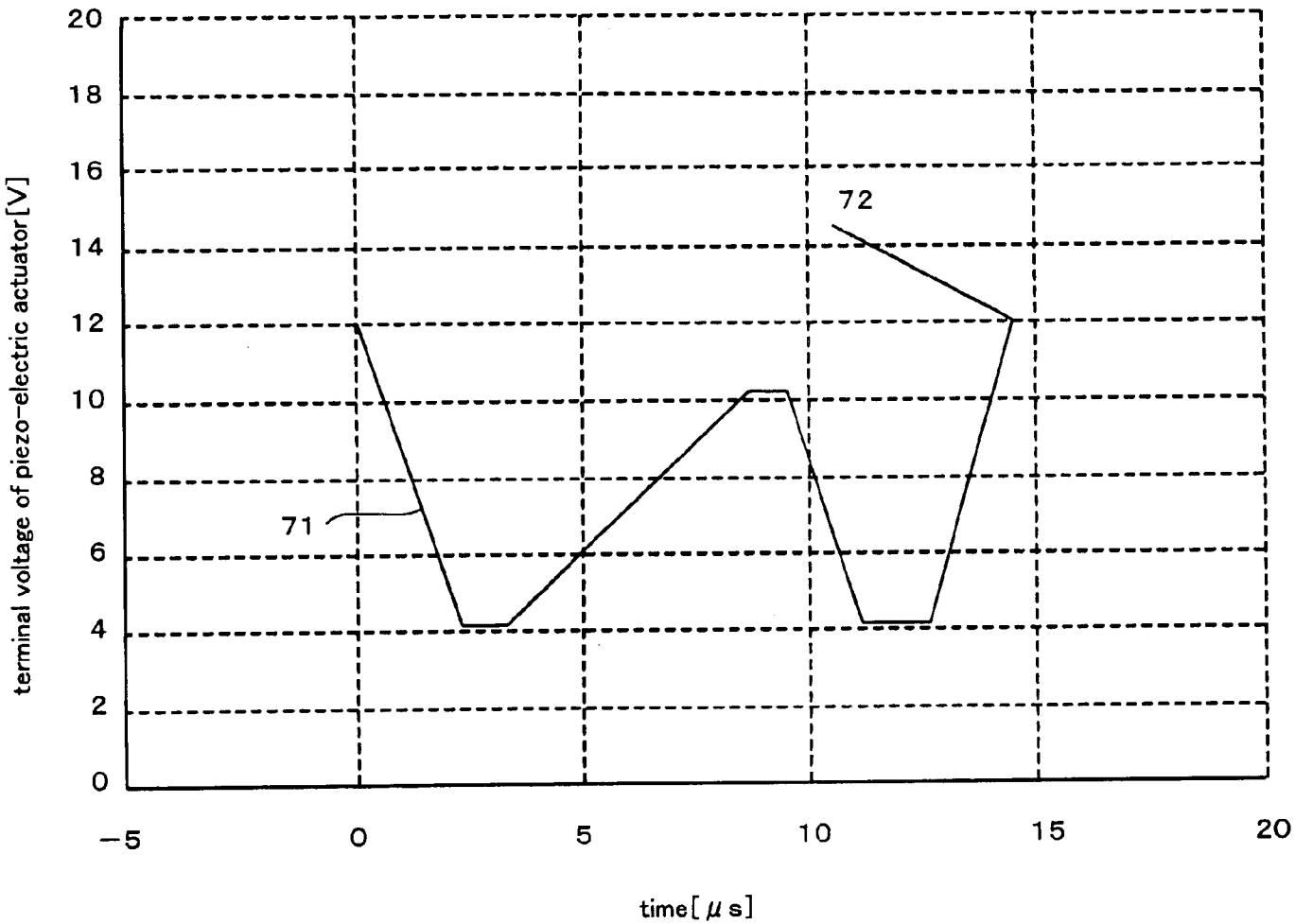
FIG. 7 illustrates an improvement of the waveform dullness realized by the ink jet head drive circuit of the present invention.

FIG. 7 shows a calculation result of the terminal voltage of the piezoelectric actuator of this embodiment. From FIG. 7, it is clear that the dullness is improved compared with the terminal voltage shown in FIG. 4.

Figure 2:
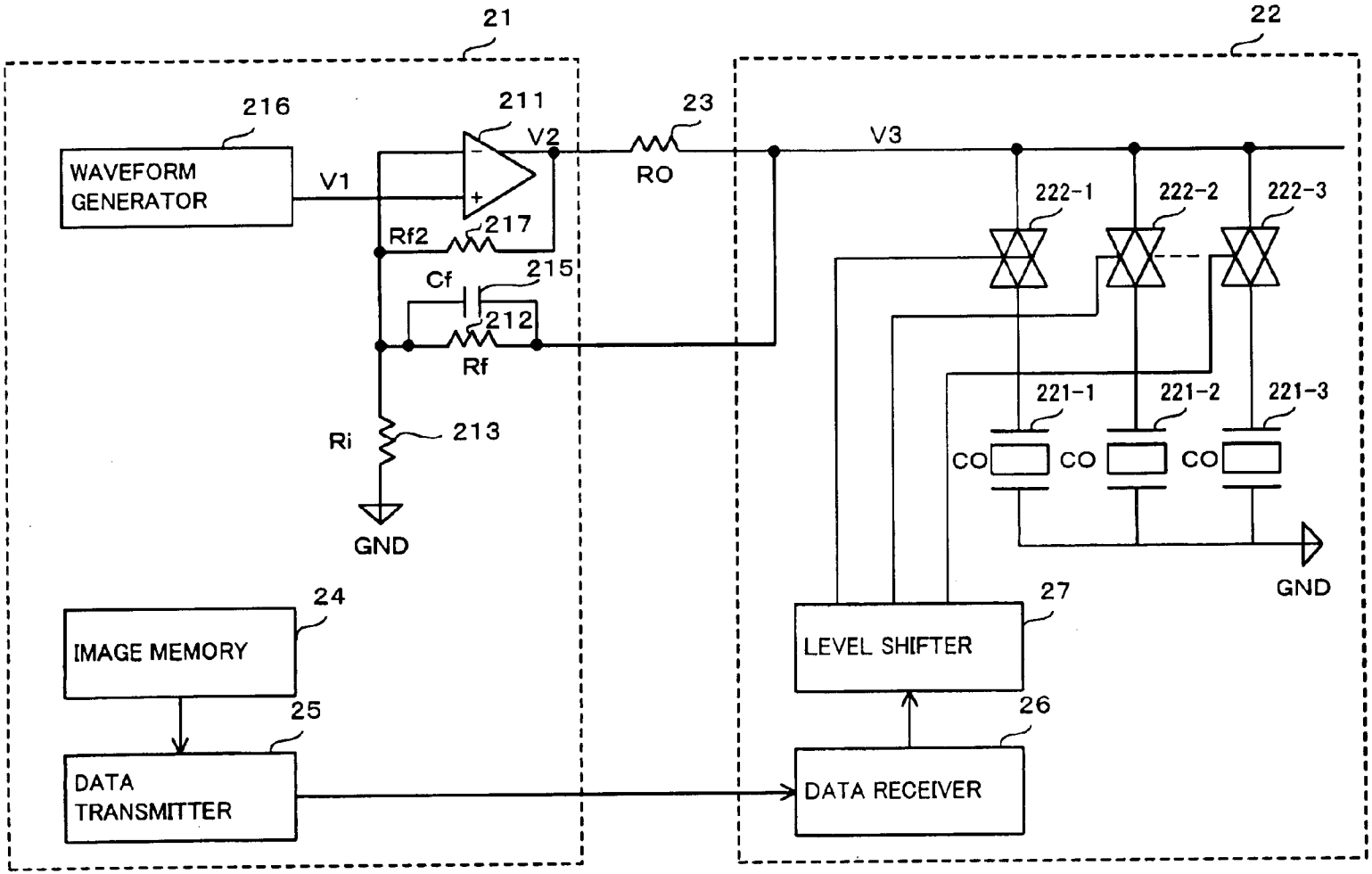
FIG. 2 is a circuit diagram of an ink jet head drive circuit according to a second embodiment of the present invention.

Now, other embodiments of the present invention will be described. These embodiments are featured by measures to oscillation although they have basic constructions similar to that of the described embodiment. FIG. 2 is a circuit diagram of an example of an ink jet head drive circuit according to a second embodiment of the present invention. The ink jet head drive circuit shown in FIG. 2 differs from the drive circuit shown in FIG. 1 in that a feedback loop including resistor 217 is added between the output of power amplifier 211 to the inverted input of amplifier 211.

An output voltage $V_2$ of power amplifier 211 is phase-led with respect to an input voltage $V_3$ of transfer gates 222. Therefore, the phase-led output voltage $V_2$ is overlapped on the phase-delayed signal passed through the low-pass filter, so that the phase delay of the feedback signal in high frequency range is relaxed to thereby restrict oscillation. The amplification factor $V_3/V_1$ in the second embodiment shown in FIG. 2 is given by the following equation (7):

$$G=1+(1/R_1)\{R_{f1}R_{f2}/(R_{f1}+R_{f2})\} \quad (7)$$

As described, the present invention has the basic construction in which the negative feedback loop is provided from the intermediate circuit board having the carriage on which the piezo-electric actuators are arranged and the transfer gates for controlling drives of the piezo-electric actuators to the power amplifier of the control circuit board. With this construction of the present invention, it becomes possible to improve the dullness of the drive signal waveform of the piezo-electric actuator terminals, which is caused by the influence of the low-pass filter formed by the electric resistance of the cable existing between the power amplifier and the ink jet head and the electrostatic capacitance of the piezo-electric actuators. As a result, a drive circuit of an ink jet head capable of stably jetting ink droplets is provided.

Incidentally, although the present invention has been described with the preferred embodiments, the described embodiments can be variously modified within the scope of the present invention.

As is clear from the description of the invention, the drive circuit of the ink jet head, according to the present invention, can stably jet ink droplets by forming a low-pass filter by electric resistance of the cable existing between the power amplifier and the ink jet head and electrostatic capacitance of the piezo-electric actuators and improving the dullness of the terminal voltages of the piezo-electric actuators due to the influence of the low-pass filter.

What is claimed is:

1. A drive circuit for an ink jet head having nozzles, pressure generating chambers filled with ink to be discharged from said nozzles, and piezoelectric actuators corresponding to respective pressure generating chambers, said ink jet head discharging ink droplets from said nozzles by changing volumes of said pressure generating chambers in response to a drive waveform signal applied to said piezoelectric actuators, said drive circuit comprising:

a waveform generator generating said drive waveform signal;

a power amplifier amplifying said drive waveform signal supplied to a first input of said power amplifier and outputting said drive waveform signal to said piezoelectric actuators via a first electrical connection having a first end coupled to the power amplifier and a second end coupled to the piezoelectric actuator; and a feedback loop having a resistor connected with a capacitor in parallel and feeding a terminal voltage at the second end of the first electrical connection applied to said piezoelectric actuators back to a second input of said power amplifier wherein the terminal voltage is fed via the resistor, wherein a first end of the feedback loop is connected to the second end of the first flexible cable.

2. A drive circuit for an ink jet head having nozzles, pressure generating chambers filled with ink to be discharged from said nozzles, and piezoelectric actuators corresponding to respective pressure generating chambers, said ink jet head discharging ink droplets from said nozzles by changing volumes of said pressure generating chambers in response to a drive waveform signal applied to said piezoelectric actuators, said drive circuit comprising:

a waveform generator generating said drive waveform signal;

a power amplifier amplifying said drive waveform signal supplied to a first input of said power amplifier and outputting said drive waveform signal to said piezoelectric actuators via a first electrical connection having a first end coupled to the power amplifier and a second end coupled to the piezoelectric actuator; and a feedback loop having a resistor connected with capacitor in parallel and feeding back a terminal voltage at the second end of the first electrical connection of said piezoelectric actuators and said output signal of said power amplifier to a second input of said power amplifier wherein the terminal voltage is fed via the resistor, wherein a first end of the feedback loop is connected to the second end of the first flexible cable.

3. A method of driving an ink jet head, said ink jet head having nozzles, pressure generating chambers filled with ink to be discharged from said nozzles, and piezoelectric actuators corresponding to respective pressure generating chambers, said ink jet head discharging ink droplets from said nozzles by changing volumes of said pressure generating chambers in response to a drive waveform signal applied to said piezoelectric actuators, said method comprising the steps of:

generating said drive waveform signal;

inputting said drive waveform signal to a first input of a power amplifier to produce an amplified drive waveform signal, and supplying said amplified drive waveform signal to said piezoelectric actuators via a first electrical connection having a first end coupled to the power amplifier and a second end coupled to the piezoelectric actuator; and feeding said amplified drive waveform signal at the second end of the first electrical connection supplied to said piezoelectric actuators back to a second input of said piezoelectric actuators wherein the terminal voltage is fed via a resistor connected in parallel with a capacitor, wherein a first end of the feedback loop is connected to the second end of the first flexible cable.

* * * * *